United States Patent [19]

Ueno

[11] 4,154,199

[45] May 15, 1979

[54] RECIPROCATING AND ROTARY INTERNAL COMBUSTION ENGINE

[76] Inventor: Yasuo Ueno, No. 179, Koadachi, Komae-shi, Tokyo, Japan

[21] Appl. No.: 782,169

[22] Filed: Mar. 28, 1977

[51] Int. Cl.[2] ..... F02B 57/00

[52] U.S. Cl. ..... 123/44 D; 123/44 R

[58] Field of Search ..... 123/44 R, 44 D, 8.13, 123/32 ST, 48 R, 48 D, 193 R, 193 C, 193 H, 191 S

[56] References Cited

U.S. PATENT DOCUMENTS

| | | | |
|---|---|---|---|
| 1,568,638 | 1/1926 | Summers | 123/48 R |
| 2,028,760 | 1/1936 | Dillstrom | 123/193 R |
| 2,113,904 | 4/1938 | Rippe | 123/48 R |
| 3,167,058 | 1/1965 | Czike | 123/44 D |
| 3,200,797 | 1/1965 | Dillenberg | 123/44 D |
| 3,205,877 | 9/1965 | Rychlik | 123/44 D |
| 3,854,460 | 12/1974 | Raptis | 123/44 D |
| 3,865,093 | 2/1975 | Rodriquez | 123/44 D |
| 3,886,913 | 6/1975 | Blanchard | 123/44 D |
| 3,968,777 | 7/1976 | Franke | 123/44 R |

FOREIGN PATENT DOCUMENTS

| | | | |
|---|---|---|---|
| 1182470 | 11/1964 | Fed. Rep. of Germany | 123/44 D |

*Primary Examiner*—Carlton R. Croyle
*Assistant Examiner*—Michael Koczo, Jr,
*Attorney, Agent, or Firm*—Robert E. Burns; Emmanuel J. Lobato; Bruce L. Adams

[57] ABSTRACT

A reciprocating and rotary internal combustion engine has a housing provided with an intake port and an exhaust port, a rotary member adapted to continuously rotate within the housing and provided with a plurality of cylindrical holes or bores in which a piston slides. A crank shaft and respective piston are connected to each other through an eccentric ring which is rotatably mounted in the piston. A set of eccentric rings are rotatably mounted on an eccentric portion of the crank shaft. Thus, a piston reciprocally moves in the individual cylindrical bores.

3 Claims, 9 Drawing Figures

RECIPROCATING AND ROTARY INTERNAL COMBUSTION ENGINE

BACKGROUND OF THE INVENTION

The present invention is concerned with a reciprocal and rotary engine and more particularly with a gasoline or diesel internal combustion engine of reciprocal and rotary operation.

Recently, Wankel type rotary engines have been rapidly developed and used, because of many advantages in the performance and structure thereof when compared with a conventional reciprocating engine. However, the rotary engine has a considerable number of disadvantages. Some of the disadvantages are that combustion gas and fuel gas are leaked through the gaps between the apex seals mounted in the rotor and the inner wall of the rotor housing or cylinder, because the seals contact with the rotor housing only in line. Another disadvantage resides in the complicated cocoon shape of the inner wall of the rotor housing. The precise shape of the rotor housing is difficult to be manufactured, so that the manufacturing cost of the housing is very high. According to still another disadvantage of the conventional rotary engine burning temperature of mixed gas of fuel and air is low, so that fuel consumption of the rotary engine becomes high and clean exhaust gas is not obtained.

SUMMARY OF THE INVENTION

The above-mentioned disadvantages of the conventional rotary engine are solved by providing a novel and high-performance internal-combustion engine. According to the principle of the invention, the internal-combustion engine comprises a reciprocating mechanism in order to prevent the combustion gas and fuel gas from leaking out and employ a circular inner wall of the casing, and a rotary mechanism in order to obtain smooth transmission of the driving power to the wheel shaft.

An object of the present invention is to provide an unique internal-combustion engine so improved by employing the principles of a reciprocating mechanism and a rotary mechanism to obtain excellent performance and clean exhaust gas.

An additional object of the present invention is to provide a novel internal-combustion engine of compact size and manufactured economically and easily.

BRIEF DESCRIPTION OF THE DRAWINGS

Referring to the drawings.

DESCRIPTION OF THE PREFERRED EMBODIMENTS

Figure 1:
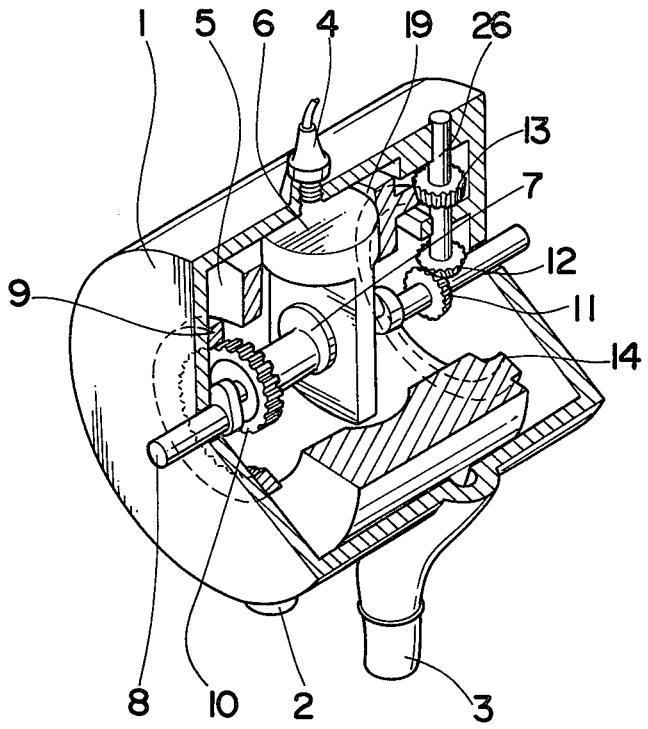
FIG. 1 is perspective view of an embodiment of a primitive type of single cylinder-type of an internal combustion engine of reciprocating and rotary operation according to the present invention.

Referring first to FIG. 1, a housing 1 of the single-cylinder internal combustion engine of reciprocating and rotary operation according to the present invention has an intake port 2, an exhaust port 3 and an ignition device 4. Within the housing 1, a rotary member 5 is so mounted as to rotate leaving a slight clearance between its outer peripheral surface and an inner wall 18 of the housing 1. As shown in FIG. 1, the rotary member 5 has a single cylindrical hole or bore 19 so made as to extend along the line perpendicular to the rotary center line of the rotary member 5.

Figure 3:
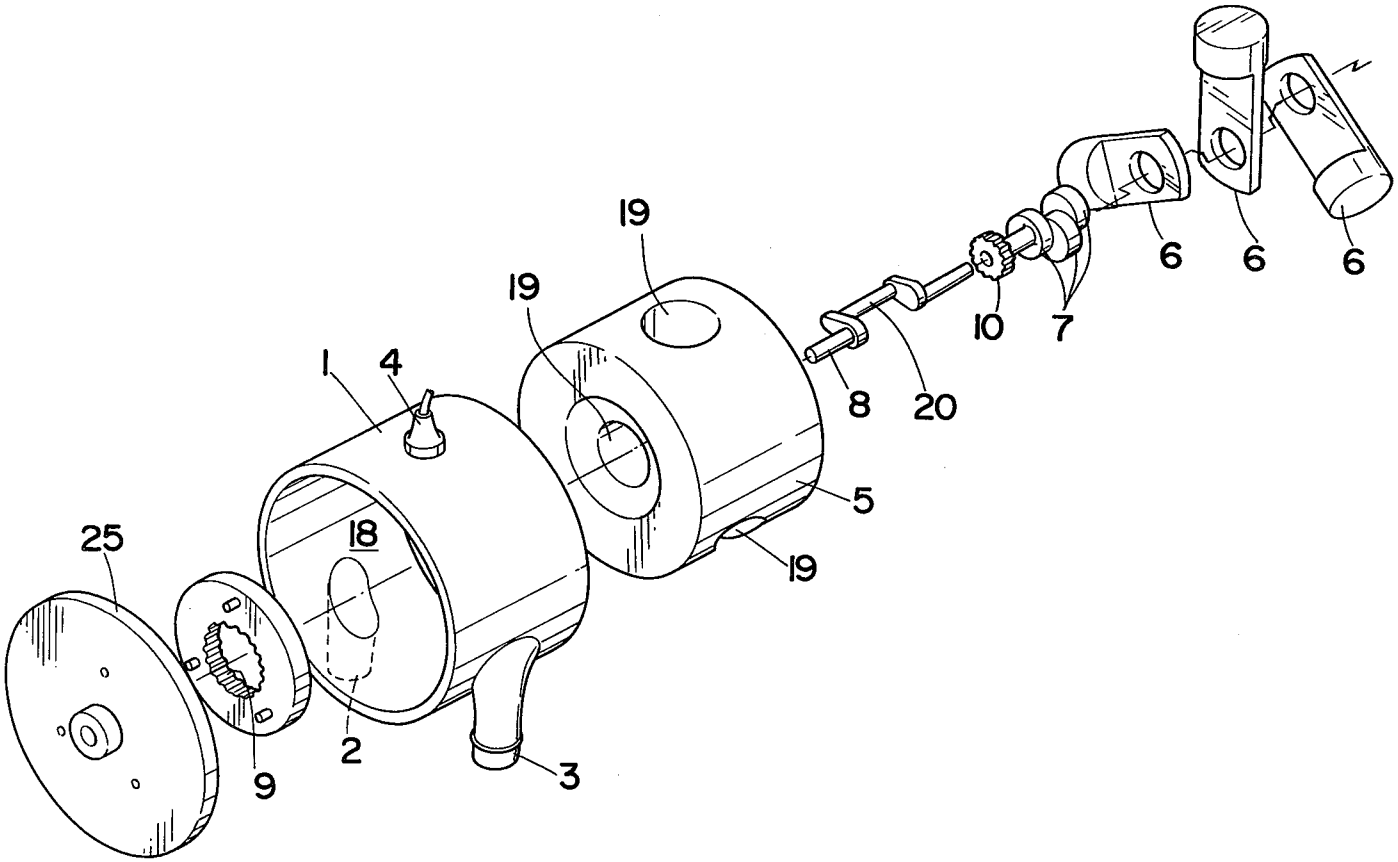
FIG. 3 is an exploded view of another embodiment of a three-cylinder internal-combustion engine of reciprocating and rotary operation according to the present invention.

According to a second embodiment of a practically-used three-cylinder internal-combustion engine shown in FIG. 3, three pistons 6 are slidably placed in three cylindrical holes 19 formed in the rotary member 5. The cylinder holes 19 individually extend along the radial directions of 120° from the center of the rotary member 5. Eccentric discs or portions 7 are inserted in openings formed in end portions of the pistons 6 and rotatably mounted on an eccentric shaft 20 connected to a crank shaft 8. The eccentricity of the respective eccentric portions 7 and that of the crank shaft 8 from the center of the eccentric shaft 20 are the same to each other.

An internal gear 9 fixedly mounted on a lid 25 of the housing 1 (see FIG. 3) or firmly attached to the housing 1 (see FIG. 1) engages with a spur gear 10 rotatably mounted on the shaft 20. The spur gear 10 is integrally connected to the eccentric portions 7. The gear ratio of the internal gear 9 and the spur gear 10 is 4:3.

Attention shoud be paid to the fact that the first embodiment of the present invention has a set of four bevel gears in order to continue a rotation of the rotary member 5 along a direction. As shown in FIG. 1, the first bevel gear 11 is mounted on an end portion of the crank shaft 8 opposite to the other end portion on which the spur gear is rotatably mounted. The first bevel gear 11 engages with a second bevel gear 12 mounted on an end of a perpendicular shaft 26. Third bevel gear 13 mounted on the other end of perpendicular shaft 26 engages with fourth bevel gear 14 formed on a side of the rotary member 5. The specific size of various bevel gears is made so as to rotate the rotary member 5 once when the crank shaft 8 rotates three times.

The operation of the reciprocating and rotary engine will be explained with reference to FIGS. 2(A), 2(B), 2(C) and 2(D).

Figure 2A:
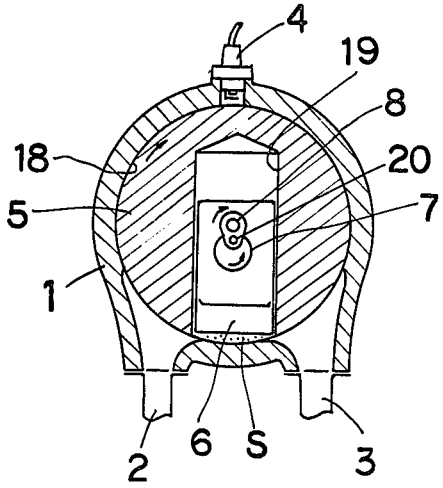
FIGS. 2(A), 2(B), 2(C), and 2(D) are individual operation diagrams showing various situations of the reciprocating and rotary moving parts of a single-cylinder engine.

When the eccentric shaft 20 and the eccentric portion 7 are individually situated at their lowest position shown in FIG. 2(A) the piston 6 is located at the lowest position in the cylindrical hole 19 and a space S defined by the housing 1, the rotary member 5 and the piston 6 has its smallest volume. At this position of the moving parts, the space S is opened to the intake port 2.

Figure 2B:
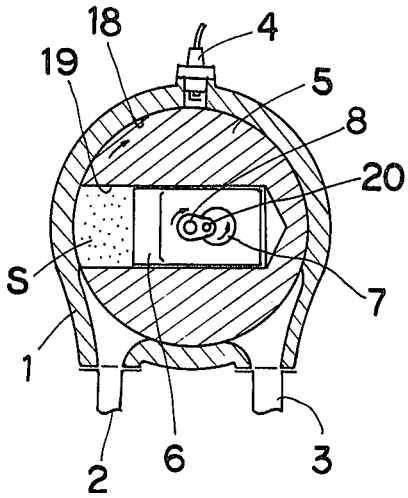

Then, the crank shaft 8 rotates as an intake stroke clockwise through an angle of 270° and reaches the position shown in FIG. 2(B). At this instant, the eccentric shaft 20 is situated at its right position and additionally the eccentric portion 7 has rotated counter-clockwise for 90° along the arrow shown on the portion so as to reach its right position. By this instant, the rotary member 5 has rotated clockwise for 90° or one fourth of its revolution. Therefore, the piston 6 moves to its far right position and the space S has its largest volume. During the intake stroke of the engine, a gas and air mixture is sucked into the space S through the intake port 2 connected to a carburetor (not shown).

Figure 2C:
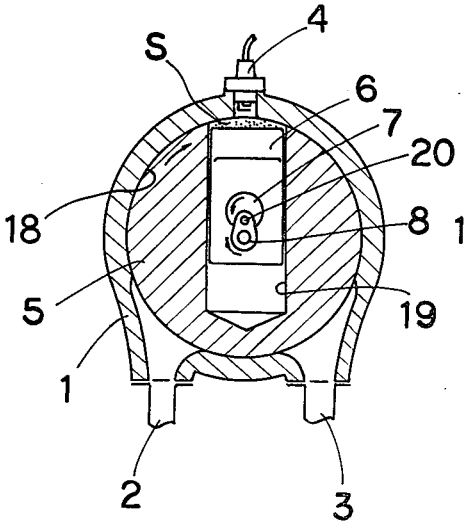

When the rotary member 5 rotates clockwise for 180° as a compression stroke starting from the position of FIG. 2(A), the cylindrical hole 19 opens upward, the crank shaft 8 rotates clockwise 15 times and the eccentric shaft 20 is situated at its top position shown in FIG. 2(C). At this instant, the volume of the space S is its smallest one or minimum similar to FIG. 2(A) and the mixture of gas and air in the space is compressed. The gas is ignited by means of an ignition device 4 and burns and expands to lower the piston 6 and the rotary member 5.

Figure 2D:
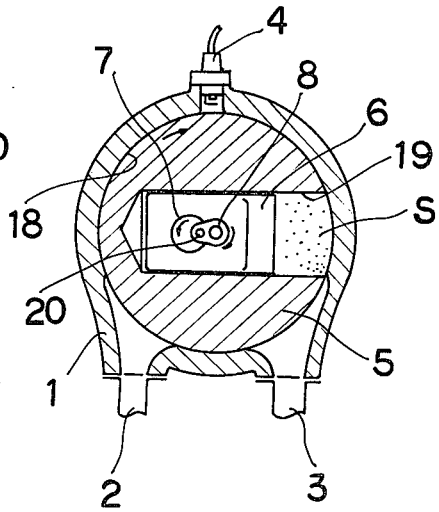

When the crank shaft 8 rotates during an expansion stroke clockwise during nine-fourths of its revolution starting from the position of FIG. 2(A) the eccentric shaft 20 is situated at its left position, the eccentric portion 7 rotates counter-clockwise third-fourths of its revolution and is disposed at its leftmost position. During the expansion stroke of the engine, the rotary member 5 rotates through 90° and the piston 6 is situated at its most left position as shown in FIG. 2(D). At this instant, the volume of the space S becomes its largest one or maximum and the expansion stroke ends. Immediately after this instant, the space S is opened to the exhaust port 3 and the exhaust stroke begins.

At last, the crank shaft 8 rotates twelve-fourths or three times and reaches the position shown in FIG. 2 (A). At this position, the eccentric portion 7 rotates counter-clockwise once and comes back to its starting position and the rotary member 5 rotates clockwise once and comes back to its starting position.

As described above, in the reciprocating and rotary internal combustion engine of the present invention, the intake stroke, the compression stroke, the ignition stroke and the expansion stroke of the engine are not finished until the crank shaft rotates three times. When the three-cylinder and piston mechanism is employed, the continuous rotation of the crank shaft is obtained without the set of bevel gear used in the single-cylinder engine shown in FIG. 1.

That is to say, the single set of eccentric portion 7 and the crankshaft 8 in the single-cylinder engine may be stopped at the particular position or the transient position between the respective positions of FIG. 2(A) and FIG. 2(B), at this position the directions of eccentricity of both are directed in opposite directions, so that the central point of the eccentric portion or disc 7 corresponds with the rotary center of the crankshaft 8. It is apparent that no force of rotation is supplied to them from the piston 6 when they are placed at this particular position.

It is necessary to employ a set of bevel gears 11,12 and 13 in the single cylinder engine in order to transfer the rotation force of the piston 6 to the rotary member 5 through the set of eccentric portion 7 and the crankshaft 8.

In case of a multicylinder engine, it is sure that at least one of the three sets of the eccentric portion 7 and the crankshaft 8 is placed at its effective position, at which position the set is supplied with a rotation force or torque from the piston 6, because if one set of the eccentric portion 7 and the crankshaft 8 is placed at its no-effect position, the other two sets of them are at their effective positions such as these shown in FIGS. 2(A), 2(B), 2(C) and 2(D) respectively, the eccentric portion 7 and the crankshaft 8 are supplied with an effective rotation force or torque, in the directions shown (see the arrows in the drawing) from the piston 6 during its sliding motion along the cylindrical wall 19. Thereby, the crankshaft 8 rotates continuously without any bevel gear.

As apparently shown in the drawing, any valve mechanism is not necessary to employ at the intake port and the exhaust port. All the rotary moving parts are moved according to the composite uniform rotary motion, so that good rotary balance is obtained in the engine without hazardous vibration.

When a set of an internal gear and a spur gear is employed to fix or determine the rotation ratio of the crankshaft 8 and the eccentric disc 7 in a three-cylinder engine shown in FIG. 3, the rotation ratio of the crankshaft 8 and the rotary member 5 is also fixed. As a result, the set of bevel gears shown in FIG. 1 for fixing the rotation ratio of the crankshaft 8 and the rotary member 5 can be omitted.

On the contrary, when the set of bevel gears is employed in the three-cylinder engine to fix the rotation ratio of the rotary member 5 and the crankshaft 8, the rotation ratio of the eccentric portion 7 and the crankshaft 8 is also fixed and, so that the set of the internal gear and the spur gear for fixing the ratio thereof can be omitted.

According to the three-cylinder internal combustion engine shown in FIG. 3, when the rotation ratio of the crank shaft 8 and each eccentric portions 7 is fixed, the ratio of the rotary member 5 and the crank shaft 8 is restricted and self-moved by the motion of three pistons 6, so that any transmission gear for operatively interconnecting the crank shaft 8 and the rotary member 5 can be advantageously omitted.

On the contrary, when the rotation ratio of the crank shaft 8 and the rotary member 5 is fixed, the ratio of the eccentric portions 7 and the crank shaft 8 is determined of itself and they are self-moved, so that the transmission gear is omitted.

As described above, the respective rotational phase of three pistons 6 of the engine is shifted by an angle of 120° relative to each other and the places of the upper dead center and the lower dead center are common to the pistons 6, respectively only one of the intake ports 2, exhaust ports 3 and ignition device 4 need to be employed.

With reference to the space S, it rotates continuously within the housing 1 owing to the rotation of the rotary member 5 and contacts at all times with the inner wall 18 of the housing 1, therefore the temperature of the housing 1 is kept at rather low. Burning of the mixture in the space S does not raise too high the temperature and generation of nitrogen oxide is restricted so as to obtain a clean exhaust gas of the engine.

According to the principle of the internal combustion engine, when the burning temperature of mixed gas is low, its burning efficiency becomes low. In the conventional rotary engine of the Wankel type, there is no countermeasure to the low burning efficiency of mixed gas.

Figure 4:
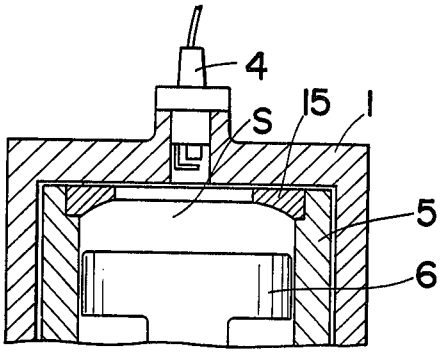
FIG. 4 is a partly sectional fragmentary schematic view showing the moving parts such as a piston, a cylinder and a housing with an ignition plug installed therein.

According to the modification of the present invention shown in FIG. 4, the problem of low burning efficiency is effectively solved by providing a partition wall or ring 15 in the cylindrical hole 19 formed in the rotary member 5 in order to reduce the contacting surface area between the space S and the housing 1 and to prevent lowering of the burning temperature lowering.

Figure 5:
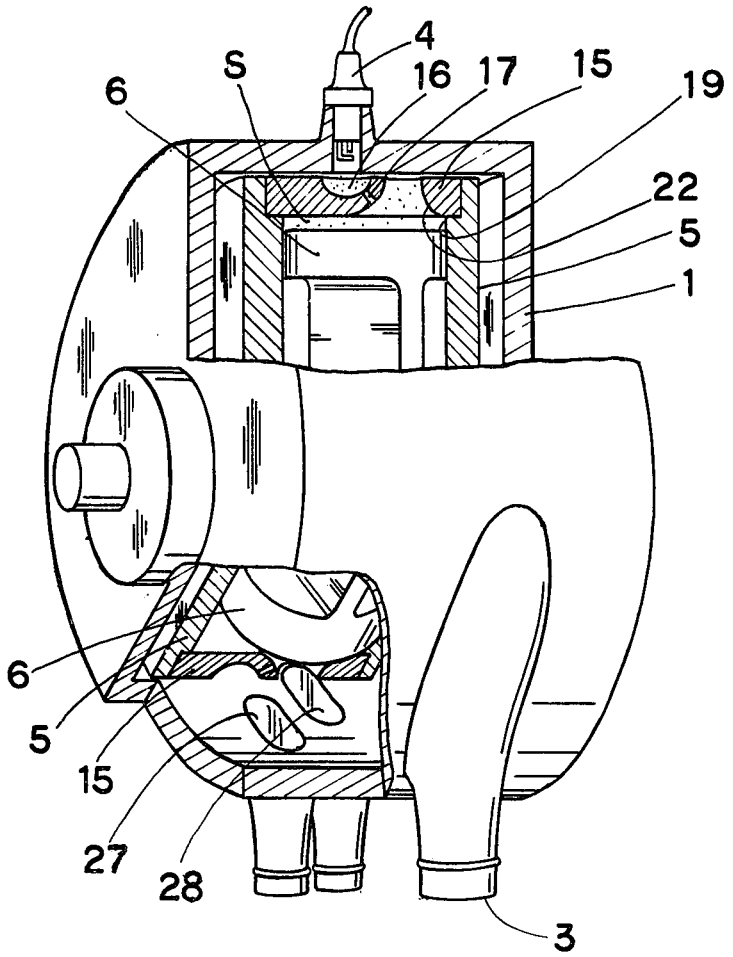
FIG. 5 is a partly sectional view and shows another embodiment of a partition wall having a combustion cavity and a passage connecting the cavity and a space.

According to a fourth modified form of the present invention shown in FIG. 5, the problem of generating nitrogen oxide is completely solved by further providing a cavity 16 and a passage 17 connecting it to the space S in the partition wall 15. In this case, the structure of the housing is so changed as to have a first intake port 27 and a second intake port 28 instead of the common intake port 2 shown in FIG. 1. Through the first intake port 27, a relatively rich mixture is supplied to the cavity 16. Through the second intake port 28, relatively a lean mixture is supplied to the space S. However, one exhaust port can still be employed in order to open the exhaust port to both the cavity and the inner space simultaneously, resulting in an improvement of the exhaust efficiency.

When the cylindrical hole 19 is situated at the position of FIG. 2(C), at first the relatively rich mixture contained in the cavity 16 is ignited by means of an ignition device 4 and then the flame of the burning mixture injects into the space S to completely burn the relatively lean mixture. Thus, clean exhaust gas is obtained.

Figure 6:
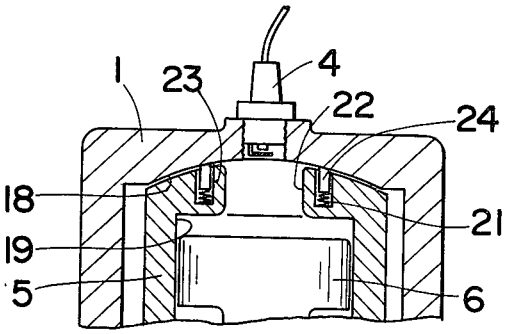
FIG. 6 is a view similar to FIG. 4 and shows another embodiment of the cylinder and the housing with a curved inner wall.

According to the still another embodiment of the present invention, the housing 1 and the rotary member 5 are more completely sealed by a unique designed sealing device shown in FIG. 6. As apparently shown in the drawing, curved sliding surfaces of the housing 1 and the rotary member 5 correspond to each other and a groove 23 of ring-shape is formed at the periphery of an opening 22 of the cylindrical hole 19.

In the groove 23, a ring seal 24 is fitted and the top end or circumferential surface of the seal 24 is pressed onto the curved inner wall 18 in order to prevent the mixture gas from leaking. Owing to the spherical inner surface of the inner wall 18 of the housing 1, any seal ring of circle functions completely and effectively.

To the diesel engine of high burning pressure, a plurality of seal rings may be employed in order to obtain more effective sealing effect.

It will be obvious that the invention is not limited to that particular form of the invention, but is capable of being embodied in many forms.

What is claimed is:

1. A reciprocating and rotary internal combustion engine comprising, a housing having a circular inner wall and an intake port and an exhaust port respectively formed in said housing to open through the circular inner wall, a rotary member rotatable in said housing leaving a small clearance relative to said circular inner wall, said rotary member having three radial, cylindrical bores formed and arranged in said rotary member spaced from each other in a circumferential direction by an angle of 120°, a crankshaft three pistons respectively slidable in a corresponding one of said cylindrical bores, three eccentric portions respectively and loosely mounted on said crankshaft out of phase from each other by an angle of 120°, said eccentric portions being rotatably fitted in respective holes formed at an end portion of said pistons, and a first gear connected to said eccentric portions loosely mounted on the crankshaft and a second gear meshing therewith fixed to said housing, said first gear and said second gear having a gear ratio 3:4, wherein the gear ratio is determined to rotate said rotary member rotates once in a direction and to rotate said crankshaft three times in the same direction as said rotary member and said eccentric portions rotate once in an opposite direction.

2. A reciprocating and rotary internal combustion engine according to claim 1, further comprising three thermal insulating partition wall rings respectively fixed at respective circular edges of said cylindrical bores, reducing the contacting area between said inner wall of housing and an open area of said a corresponding cylindrical bore.

3. A reciprocating and rotary internal combustion engine according to claim 1, in which each partition wall ring respectively has a cavity opening to said inner wall of the housing and a passage connecting the cavity and an inner space of said cylindrical bore, said intake port being divided into two portions, a first of which is made for a rich mixture and a second is made for a lean mixture, therefore when said cavity and said inner space coincide with said intake port, the first portion of the intake port opens to the cavity and the second portion opens to inner space and when said cavity and said inner space open to the exhaust port, said exhaust port opens to both the cavity and the inner space simultaneously.

* * * * *